US008235873B1

(12) United States Patent
Stearns et al.

(10) Patent No.: US 8,235,873 B1
(45) Date of Patent: Aug. 7, 2012

(54) EXERCISE METHODS AND APPARATUS WITH VARIABLE FOOT MOTION

(76) Inventors: Kenneth W. Stearns, Houston, TX (US); Joseph D. Maresh, West Linn, OR (US)

( * ) Notice: Subject to any disclaimer, the term of this patent is extended or adjusted under 35 U.S.C. 154(b) by 0 days.

(21) Appl. No.: 12/408,673

(22) Filed: Mar. 20, 2009

Related U.S. Application Data

(60) Provisional application No. 61/070,215, filed on Mar. 20, 2008.

(51) Int. Cl.
*A63B 22/00* (2006.01)

(52) U.S. Cl. ..... 482/51; 482/52

(58) Field of Classification Search ..... 482/51–53, 482/57, 70, 71; 434/247, 255
See application file for complete search history.

(56) References Cited

U.S. PATENT DOCUMENTS

| | | | | |
|---|---|---|---|---|
| 5,779,599 | A * | 7/1998 | Chen | 482/57 |
| 5,993,359 | A * | 11/1999 | Eschenbach | 482/57 |
| 6,024,676 | A * | 2/2000 | Eschenbach | 482/51 |
| 6,077,198 | A * | 6/2000 | Eschenbach | 482/52 |
| 6,090,014 | A * | 7/2000 | Eschenbach | 482/52 |
| 6,302,825 | B1 * | 10/2001 | Stearns et al. | 482/52 |
| 6,450,925 | B1 * | 9/2002 | Kuo | 482/52 |
| 6,554,750 | B2 * | 4/2003 | Stearns et al. | 482/57 |
| 6,569,061 | B2 * | 5/2003 | Stearns et al. | 482/52 |
| 6,620,079 | B2 * | 9/2003 | Kuo | 482/51 |
| 6,726,600 | B2 * | 4/2004 | Miller | 482/51 |
| 7,041,036 | B1 * | 5/2006 | Kuo | 482/52 |
| 7,060,004 | B2 * | 6/2006 | Kuo | 482/52 |
| 7,169,090 | B1 * | 1/2007 | Maresh | 482/52 |
| 7,507,186 | B2 * | 3/2009 | Stearns et al. | 482/52 |
| 7,604,573 | B2 * | 10/2009 | Dalebout et al. | 482/52 |
| 7,682,288 | B1 * | 3/2010 | Stearns et al. | 482/51 |
| 2002/0119867 | A1 * | 8/2002 | Stearns et al. | 482/52 |
| 2006/0223678 | A1 * | 10/2006 | MacLean | 482/51 |
| 2007/0232457 | A1 * | 10/2007 | Porth | 482/51 |
| 2008/0064571 | A1 * | 3/2008 | Lee | 482/52 |
| 2008/0227602 | A1 * | 9/2008 | Stearns et al. | 482/52 |

* cited by examiner

*Primary Examiner* — Loan Thanh
*Assistant Examiner* — Daniel F Roland
(74) *Attorney, Agent, or Firm* — Nick A. Nichols, Jr.

(57) ABSTRACT

An exercise apparatus includes a frame configured to rest on a floor surface; left and right cranks rotatably mounted on the frame; left and right first rocker links pivotally mounted on the frame; left and right drawbar links pivotally interconnected between respective cranks and respective first rocker links; left and right second rocker links pivotally mounted on the frame; and left and right foot links supported by respective cranks and respective rocker links. On one embodiment, the second rocker links are selectively pinned to respective first rocker links to configure the apparatus for elliptical striding exercise, and the second rocker links are alternatively pinned to the frame to configure the apparatus for arcuate stepping exercise. On another embodiment, adjustable length members are interconnected between respective second rocker links and respective first rocker links to accommodate variable elliptical striding motion.

5 Claims, 6 Drawing Sheets

EXERCISE METHODS AND APPARATUS WITH VARIABLE FOOT MOTION

CROSS-REFERENCE TO RELATED APPLICATION

This application claims the benefit of U.S. Provisional Application Ser. No. 61/070,215, filed. Mar. 20, 2008, which application is incorporated herein by reference.

FIELD OF THE INVENTION

The present invention relates to exercise methods and apparatus, and more specifically, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to step or climb in place; bicycle machines allow a person to pedal in place; and still other machines allow a person to ski and/or stride in place.

Yet another type of exercise equipment has been designed to facilitate relatively more complicated exercise motions and/or to better simulate the human striding motion. This equipment typically uses a linkage assembly to convert a relatively simple motion, such as circular, into a relatively more complex motion, such as elliptical. Examples of these elliptical motion exercise machines are disclosed in U.S. Pat. No. 4,185,622 to Swenson; U.S. Pat. No. 5,279,529 to Eschenbach; U.S. Pat. No. 5,383,829 to Miller; U.S. Pat. Nos. 5,540,637 to Rodgers, Jr.; 6,196,948 to Stearns et al.; and U.S. Pat. No. 6,468,184 to Lee, all of which are incorporated herein by reference to help provide context for better understanding of the subject invention.

SUMMARY OF THE INVENTION

Generally speaking, the present invention provides novel linkage assemblies and corresponding exercise apparatus that facilitate elliptical exercise motion of a variable nature. On a first embodiment, left and right amplifying rocker links are selectively pinned to respective left and right cranks to generate generally elliptical striding motions, and the rocker links are alternatively pinned to the frame to generate arcuate stepping motions. On a second embodiment, left and right adjustable length members are interconnected between respective left and right rocker links and respective left and right drawbar linkages to generate generally elliptical striding paths that vary in length as a function of the length of the adjustable length members. Additional features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
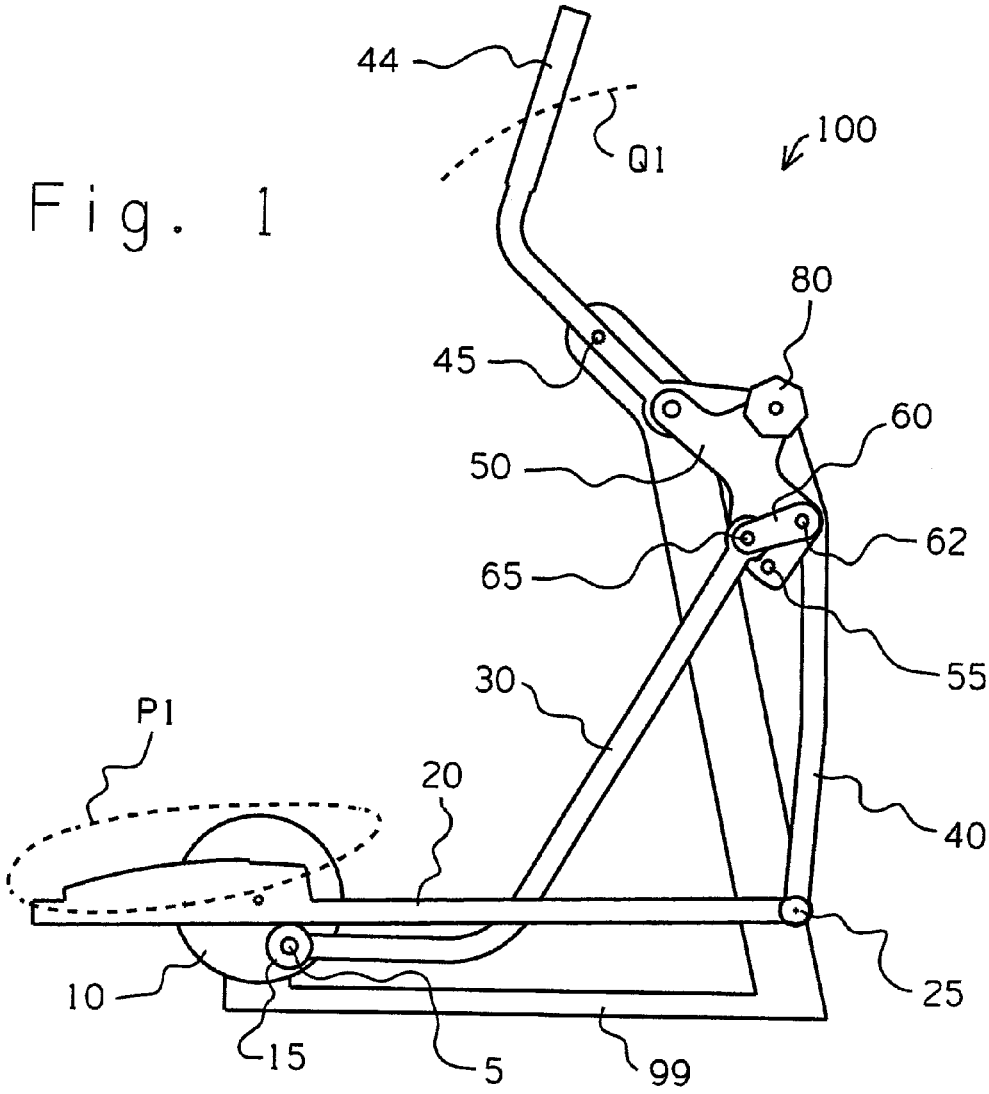
FIG. 1 is a side view of an exercise apparatus constructed according to the principles of the present invention, and configured to operate in a striding mode.

The present invention involves elliptical motion exercise machines, and methods that link so-called "elliptical motion" of left and right foot supports to rotation of left and right cranks and/or arcuate motion of left and right handlebars. The term "elliptical motion" is intended in a broad sense to describe a closed-loop path of motion having a relatively longer, major axis and a relatively shorter, minor axis (which extends perpendicular to the major axis). In general, the present invention may be said to directly use displacement of the cranks to move the foot supports in a direction coincidental with the minor axis, and indirectly use displacement of the cranks to move the foot supports in a direction coincidental with the major axis. As a result, the length of the minor axis is more directly a function of the crank diameter, while the length of the major axis is not so restricted. Moreover, as further explained below, under certain circumstances the exercise motion may be converted into an arcuate stepping motion by limiting movement of the foot supports to pivoting in a generally vertical direction.

A first embodiment of the present invention is designated as 100 in FIGS. 1-4. The exercise apparatus 100 may be described in terms of a frame 99, and left and right linkage assemblies movably mounted on the frame 99. The apparatus 100 is generally symmetrical about a vertical plane extending lengthwise through the frame 99. The linkage assembly components on the left side of the machine are preferably one hundred and eighty degrees out of phase relative to their opposite side counterparts.

The frame 99 includes a floor engaging base, a rearward stanchion that extends upward from a rearward end of the base, and a forward stanchion that extends upward from an opposite, forward end of the base. A conventional user interface (not shown) may be mounted on top of the forward stanchion to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) data transmitted over the internet; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

A laterally extending shaft or axle is rotatably mounted on the rearward stanchion, thereby defining a crank axis, and left and right cranks 10 are secured to respective ends of the shaft. The left and right cranks 10 are keyed to the shaft and thereby constrained to rotate together relative to the frame 99. As a matter of design choice, various known inertia altering devices, including flywheels and/or resistance brakes, for example, may be connected to the cranks, either directly or in "stepped-up" fashion using a belt and different diameter drums.

In addition to a respective crank 10, each linkage assembly also includes a first rocker link 50 that is pivotally mounted on a laterally extending shaft 45 on an upper portion of the forward stanchion, and a second rocker link 40 that is also pivotally mounted on the shaft 45. On an alternative embodiment, the first rocker links pivot about a first pivot axis relative to the frame, and the second rocker links pivot about a discrete, second pivot axis relative to the frame. On another alternative embodiment, the first rocker links are pivotally mounted on respective second rocker links, instead of the frame.

Figure 2:
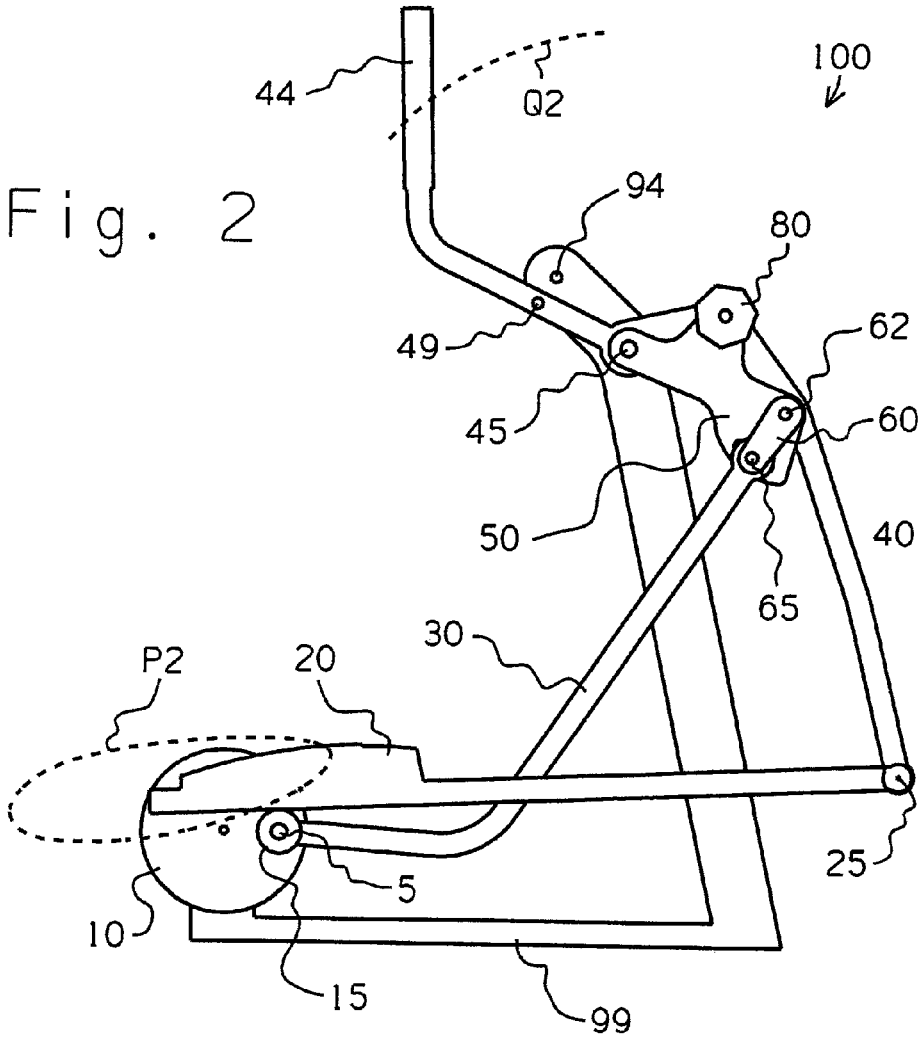
FIG. 2 is a side view of the exercise apparatus of FIG. 1, but adjusted to generate a relatively shorter exercise path while still in the striding mode.
Figure 3:
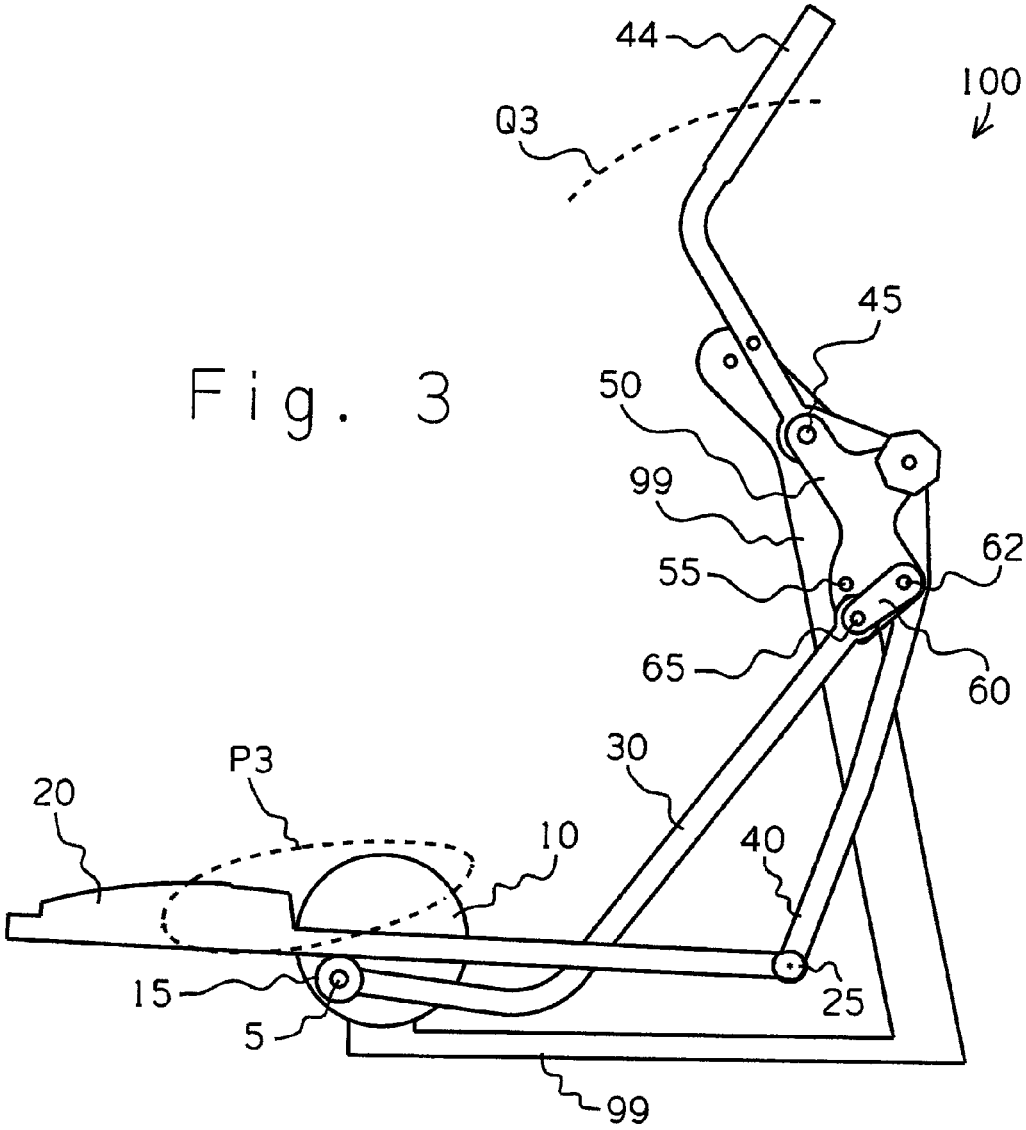
FIG. 3 is a side view of the exercise apparatus of FIG. 1, but adjusted to generate a still shorter exercise path while still in the striding mode.
Figure 4:
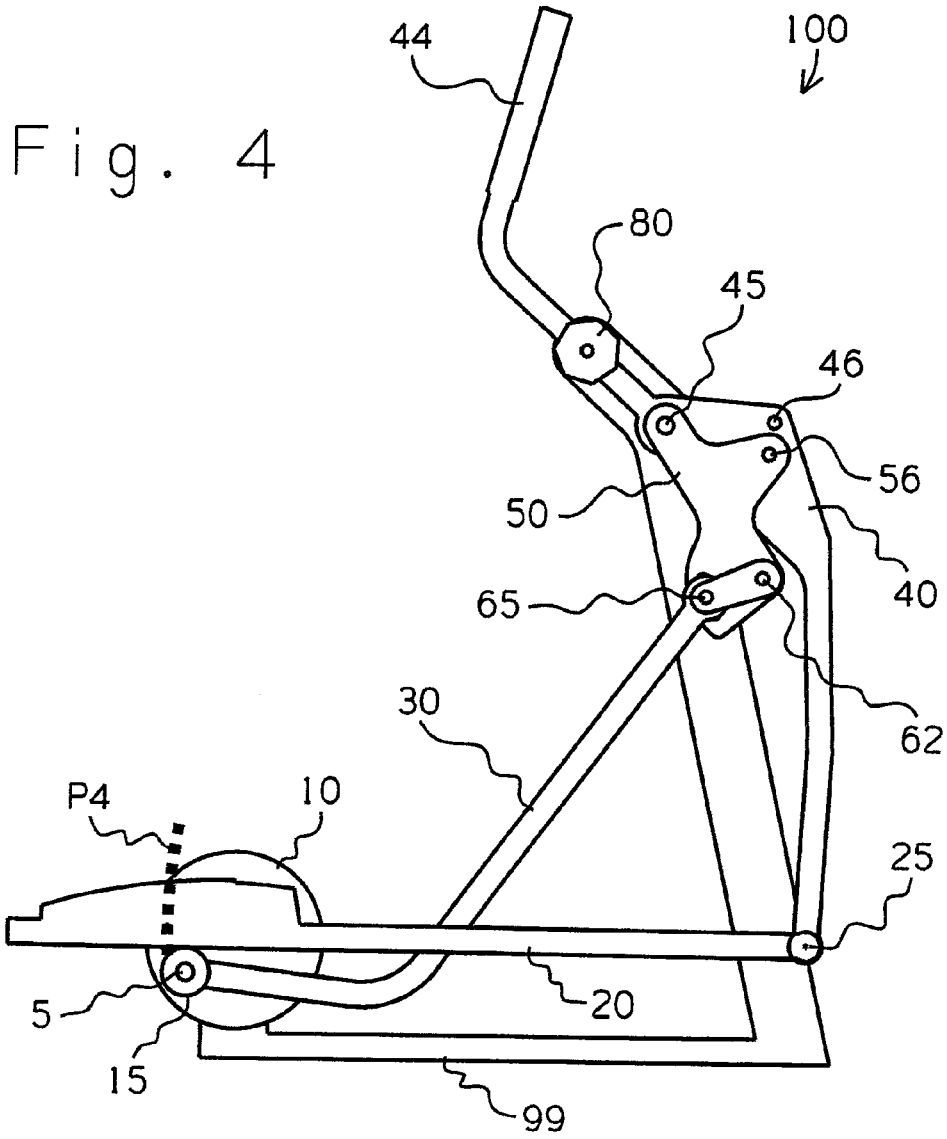
FIG. 4 is a side view of the exercise apparatus of FIG. 1 configured to operate in a stepping mode.

An upper distal end 44 of each second rocker link 40 is sized and configured for grasping. As shown in FIG. 4, holes 56 extend through the first rocker links 50, and holes 46 extend through the second rocker links 40. The holes 56 and 46 are disposed at a common radius from the shaft 45, and thus, are rotatable into alignment with one another. As shown in FIGS. 1-3, a respective fastener 80 is selectively inserted through a respective set of aligned holes 56 and 46 to selectively lock a respective first rocker link 56 relative to a respective second rocker link 46.

As shown in FIG. 2, holes 49 extend through the second rocker links 50, and holes 94 extend through the stanchion, proximate its upper end. The holes 49 and 94 are disposed at a common radius from the shaft 45, and thus, the holes 49 are rotatable into alignment with the holes 94. As shown in FIG. 4, a respective fastener 80 is removed from holes 56 and 46 and selectively inserted through a respective set of holes 49 and 94 to selectively lock a respective second rocker link 40 to the frame 99. Each fastener 80 may take various known forms, including a pin with a spring-biased ball disposed inside its distal end, or a threaded bolt, for example.

Each linkage assembly also includes a drawbar link 30 having a rearward end pivotally connected to a respective crank 10, and a forward end pivotally connected to a respective first rocker link 50. More specifically, the forward end of each drawbar link 30 is pivotally connected to a respective adjustment link 60 at a respective tube 65. In turn, each adjustment link 60 is pivotally connected to a respective first rocker link 50 at a respective pin 62. A series of holes 55 extend through each first rocker link 50, and both the respective holes 55 and a respective pivot tube 65 are disposed at a common radius from a respective pivot pin 62. A fastener, which could be similar to the fastener 80, is inserted through a respective tube 65 and an aligned one of the holes 55 to secure a respective adjustment link 60 in a desired position relative to a respective first rocker link 50. As further discussed below, the adjustment links 60 are secured in relatively higher holes 55 to create a relatively greater stride length (see FIG. 1), and the adjustment links 60 are secured in relatively lower holes 55 to generate a relatively shorter stride length (see FIG. 3). Each first rocker link 50 and associated drawbar link 30 may be described collectively as a drawbar linkage, and each associated fastener 80 may be described as a means for adjusting to what extent a respective rocker link pivots in response to motion of a respective said drawbar linkage.

Persons skilled in the art will recognize that actuators, for example, may be used instead of the fasteners 80, to reposition the adjustment links 60. On such an alternative embodiment, the actuators may be operated in response to a control signal that is based on a user pushing a button, a change in a selected exercise program, or a detected change in exercise performance. For example, the detected change in exercise performance may be a change in the user's heart rate, as detected by a monitor, or a change in the user's applied force to one of the linkage assembly members, as detected by a strain gauge, or a change in the user's level of exertion, as detected by operational characteristics of a resistance device (such as an eddy current brake) connected to the cranks 10.

Each linkage assembly also includes a foot supporting link 20 having a rearward end that is sized and configured to support the foot of a person in a standing position. A roller 15 is rotatably mounted on each crank 10, and each foot supporting link 20 is disposed on top of a respective roller 15. On the depicted embodiment 100, a common shaft 5 supports both a respective roller and a respective drawbar link 30. However, the present invention is not limited to this particular arrangement. As shown in U.S. Pat. No. 6,629,909 to Stearns et al., which is incorporated herein by reference, a crank extension link may be used to provide two separate crank connection points (e.g. see part 190 in FIG. 16 of said patent). This same patent also shows various ways to arrange the linkage assembly components laterally relative to one another on the present invention (e.g. see FIGS. 20A-20J of said patent).

FIG. 1 shows the machine 100 configured for relatively long elliptical striding motion. In this regard, each pivot tube 65 is secured in alignment with a respective uppermost hole 55 (relatively close to the pivot shaft 45). A point on each foot support 20 travels through a generally elliptical path designated as P1, and a point on each handle 44 travels through an arcuate path designated as Q1.

FIG. 2 shows the machine 100 configured for intermediate elliptical striding motion. In this regard, each pivot tube 65 is secured in alignment with a respective intermediate hole 55 (relatively further from the pivot shaft 45). A point on each foot support 20 travels through a generally elliptical path designated as P2, and a point on each handle 44 travels through an arcuate path designated as Q2.

FIG. 3 shows the machine 100 configured for relatively short elliptical striding motion. In this regard, each pivot tube 65 is secured in alignment with a respective lowermost hole 55 (still further from the pivot shaft 45). A point on each foot support 20 travels through a generally elliptical path designated as P3, and a point on each handle 44 travels through an arcuate path designated as Q3.

FIG. 4 shows the machine 100 configured for arcuate stepping motion. In this regard, each first rocker link 50 is disconnected from a respective second rocker link 40, and each second rocker link 40 is locked to the frame 99. The position of each pivot tube 65 relative to the holes 55 is not relevant in this configuration (because each first rocker link 50 simply pivots back and forth independent of the second rocker links 40). A point on each foot support 20 travels through an arcuate path designated as P4, and the handles 44 remain stationary.

Figure 5:
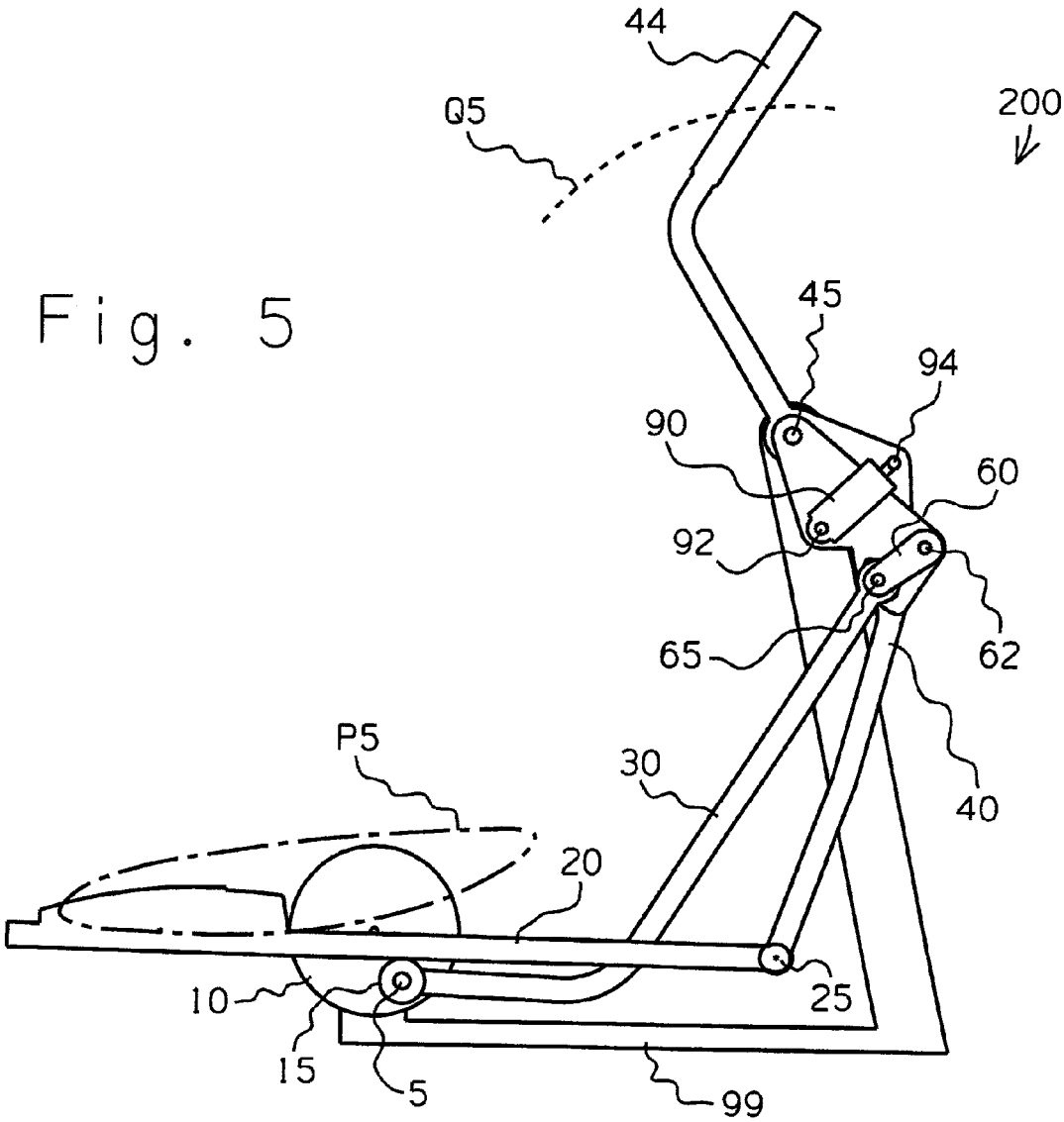
FIG. 5 is a side view of a second exercise apparatus constructed according to the principles of the present invention.
Figure 6:
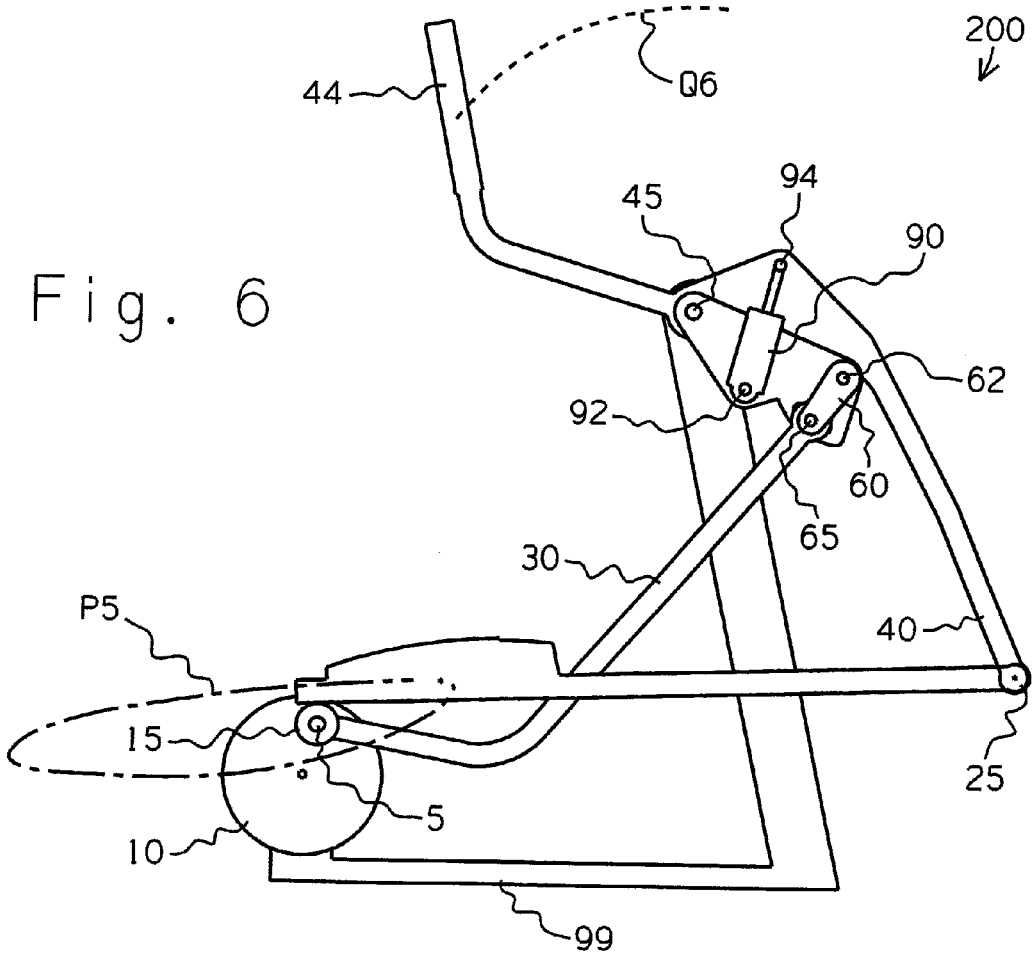
FIG. 6 is a side view of the exercise apparatus of FIG. 5, but adjusted to generate a relatively shorter exercise path.

Another alternative embodiment of the present invention is designated as 200 in FIGS. 5-6. As suggested by the common reference numerals, the machine 200 is similar in many respects to the first embodiment 100. In this regard, the machine 200 is different only to the extent that it operates in only a striding mode, and it provides a greater level of adjustability in stride length.

On each linkage assembly, an adjustable length member 90 has a cylinder end that is rotatably connected to a respective first rocker link 50 (at pivot joint 92), and an opposite, rod end that is rotatably connected to a respective second rocker link 40 (at pivot joint 94). On the depicted embodiment 200, the adjustable length members are combination springs and dampers, such as the ones disclosed in U.S. Pat. No. 5,072, 928 to Stearns, which is incorporated herein by reference. However, on an alternative embodiment, the adjustable length members are instead actuators that operate in response to a control signal (as described with reference to a previously described embodiment).

FIGS. 5 and 6 show the machine 200 configured to operate in an intermediate striding mode (like the first embodiment 100 as shown in FIG. 2). The adjustable length members 90 accommodate variation in stride lengths within a range determined by the setting of the adjustable links 60. When the adjustable length members are combination springs and dampers, the stride length varies as a function of changes in user force applied against one or more of the linkage assembly members. FIG. 5 shows the adjustable length member 90 in a relatively contracted state, placing the pivot joint 65 relatively closer to the shaft 45 (for greater amplification effect), and thereby generating a relatively longer generally elliptical path P5, and a relatively longer arcuate path Q5. FIG. 6 shows the adjustable length member 90 in a relatively extended state, placing the pivot joint 65 relatively further from the shaft 45 (for less amplification effect), and thereby generating a relatively shorter generally elliptical path P6, and a relatively shorter arcuate path Q6. As noted with reference to the embodiment 100, each first rocker link 50 and associated drawbar link 30 may be described collectively as a drawbar linkage, in which case, each associated adjustable length member may be described as a means for adjusting to what extent a respective rocker link pivots in response to motion of a respective said drawbar linkage.

The present invention has been described with the understanding that persons skilled in the art will recognize additional embodiments, improvements, and/or applications that nonetheless fall within the scope of the invention. Therefore, the scope of the present invention should be limited only to the extent of the following claims.

What is claimed is:

1. An exercise apparatus, comprising:

a frame configured to rest on a floor surface;

a left crank and a right crank, wherein each said crank is rotatably mounted on the frame;

a left first rocker link and a right first rocker link, wherein each said first rocker link is pivotally mounted on the frame;

a left second rocker link and a right second rocker link, wherein each said second rocker link is pivotally mounted on the frame;

a left drawbar link and a right drawbar link, wherein each said drawbar link is pivotally interconnected between a respective said crank and a respective said first rocker link;

a left foot support and a right foot support, wherein each said foot support is movably supported by a respective said crank and a respective said second rocker link;

an adjustable length member having an end rotatably connected to a respective said first rocker and an opposite end rotatably connected to a respective said second rocker link; and a left adjustment link and a right adjustment link selectively secured to a respective said first rocker link for adjusting the movement of a respective said foot support through a generally elliptical striding motion.

2. The exercise apparatus of claim 1, wherein an upper distal end of each said second rocker link is sized and configured for grasping by a person standing on each said foot support.

3. The exercise apparatus of claim 1, wherein a left roller is rotatably mounted on the left crank, and a right roller is rotatably mounted on the right crank, and each said foot support is disposed on top of a respective said roller.

4. An exercise apparatus, comprising:

a frame configured to rest on a floor surface;

a left crank and a right crank, wherein each said crank is rotatably mounted on the frame;

a left first rocker link and a right first rocker link, wherein each said first rocker link is pivotally mounted on the frame;

a left second rocker link and a right second rocker link, wherein each said second rocker link is pivotally mounted on the frame;

a left drawbar link and a right drawbar link, wherein each said drawbar link is pivotally interconnected between a respective said crank and a respective said first rocker link;

a left foot support and a right foot support, wherein each said foot support is movably interconnected between a respective said crank and a respective said second rocker link;

a left roller and a right roller, wherein each said roller is rotatably mounted on a respective said crank, and each said foot support is disposed on top of a respective said roller;

an adjustable length member having an end rotatably connected to a respective said first rocker and an opposite end rotatably connected to a respective said second rocker link; and left and right adjustable linkage for adjusting the movement of a respective said foot support through a generally elliptical striding motion.

5. The exercise apparatus of claim 4, wherein an upper distal end of each said second rocker link is sized and configured for grasping by a person standing on each said foot support.

* * * * *